US007386941B2

(12) United States Patent
Wagenknecht et al.

(10) Patent No.: US 7,386,941 B2
(45) Date of Patent: Jun. 17, 2008

(54) SLIT PICK AND HOLD TRIPLE FUNCTION GRAPHIC ARTS SAFETY BLADE

(76) Inventors: Terry Lee Wagenknecht, 6693 Heather La., Rockford, IL (US) 61114; Samuel James Wagenknecht, 6693 Heather La., Rockford, IL (US) 61114; Charles Maxwell Wagenknecht, 6693 Heather La., Rockford, IL (US) 61114

( * ) Notice: Subject to any disclaimer, the term of this patent is extended or adjusted under 35 U.S.C. 154(b) by 205 days.

(21) Appl. No.: 11/252,119

(22) Filed: Oct. 17, 2005

(65) Prior Publication Data

US 2007/0084065 A1 Apr. 19, 2007

(51) Int. Cl.
*B26B 9/02* (2006.01)

(52) U.S. Cl. ..... 30/357; 30/351; 30/353; 30/356

(58) Field of Classification Search ..... 30/346, 30/353, 356, 357, 165, 314, 142, 148, 351
See application file for complete search history.

(56) References Cited

U.S. PATENT DOCUMENTS

| | | | | | |
|---|---|---|---|---|---|
| 912,146 | A * | 2/1909 | Moffett | 30/353 |
| 1,490,154 | A * | 4/1924 | Tulip et al. | 30/429 |
| 1,503,143 | A * | 7/1924 | Upton | 172/13 |
| 2,019,357 | A * | 10/1935 | Oestreich | 172/371 |
| 2,140,021 | A * | 12/1938 | Mallen | 30/353 |
| D139,187 | S * | 10/1944 | Wagner | D7/650 |
| 2,635,337 | A * | 4/1953 | Mercy | 30/353 |
| 2,693,384 | A * | 11/1954 | Clarke | 294/1.1 |
| 2,814,870 | A * | 12/1957 | Treiber | 30/142 |
| 3,212,187 | A * | 10/1965 | Benedict | 606/138 |
| 4,564,072 | A * | 1/1986 | Corbett | 172/13 |
| 4,787,146 | A * | 11/1988 | Gaskins | 30/299 |
| 4,980,976 | A * | 1/1991 | Junginger et al. | 30/272.1 |
| 5,826,342 | A * | 10/1998 | Zuro | 30/279.2 |
| 5,845,404 | A * | 12/1998 | Jeffcoat | 30/125 |
| 6,401,342 | B1 * | 6/2002 | Kloss et al. | 30/272.1 |
| 2006/0288588 | A1 * | 12/2006 | Morabito | 30/294 |

* cited by examiner

*Primary Examiner*—Hwei-Siu C. Payer

(57) ABSTRACT

A triple function slitting, picking, and holding safety blade for use in the graphic arts trade; for slitting through, picking up, and holding portions of computer cut vinyl adhesive material. A slight rotation of a user's blade holding tool changes a blade's function from slitting to picking to hold-down modes with increased user safety with its restricted blade penetration and with fewer carpal tunnel stress motions required in its use. A notch within a cutting edge of and near to the apex point of a generally triangular shaped cutting blade end exposes a new cutting edge. A bend is located between the newly exposed cutting edge and the apex point to further expose the new cutting edge for sufficient clearance to slit a vinyl material's planar surface. An exterior portion of the bend serves as a blunt stylus type hold down tool which prevents any piercing of the vinyl material's surface.

1 Claim, 7 Drawing Sheets

SLIT PICK AND HOLD TRIPLE FUNCTION GRAPHIC ARTS SAFETY BLADE

CROSS-REFERENCE TO RELATED APPLICATIONS

None

STATEMENT REGARDING FEDERALLY SPONSORED RESEARCH OR DEVELOPMENT

Not applicable.

REFERENCE TO SEQUENCE LISTING

Not applicable.

BACKGROUND

1. Field of Invention

This invention relates to tool held cutting blades, awl type picking devices, and round blunt ended styluses, and particularly to those intended for use within the graphic arts trade, and especially to those which have a plurality of functions including cutting, picking, and holding graphic arts materials, and also especially those which include a slight rotational twist of a user's hand held blade holding tool for quickly changing between functions.

2. Description of Prior Art

Previous knife blades made for fine detailed hand cutting within the graphic arts trade were made with a very long and sharp point. Most blades are formed with a triangular shaped end, and with a cutting edge extending completely to a very end of a blade's apex end point tip. A long and tapered point of previous blade versions can pierce a user's skin with an ability to easily penetrate up to the full depth of a blade's long length.

A process of removing unwanted vinyl from its carrier backing is normally described as weeding. A standard picking awl which is used to pick up and pull out unwanted areas within vinyl cut adhesives can also easily penetrate a user's body up to the full depth of its shaft. A picking awl with a curved hook near its end point is safer in use, but slower in production. After cutting around an area of vinyl lettering to be removed, a user must lay down a cutting knife, find and pick up the curved end point awl, and then orient its point for picking out unwanted material. When finished with an area of material weeding, a user once again finds a cutting knife, picks it up, and orients its blade for cutting, or as in this purpose, slitting the vinyl material. In a busy shop, this process is repeated from several hundred and up to several thousand times a day with a chance each time of accidentally grabbing the wrong pointed end in the wrong way for a stabbing surprise.

A blunt and round ended hand held stylus is normally used for retaining small wanted areas of vinyl to its carrier sheet while weeding away the background, and also to prevent damage or piercing of these same wanted areas. One tool or tool-held blade which could cut or slit and or pick up and or retain different parts of a vinyl material while remaining in a user's hand in a safe and vinyl protecting way, was not found. None were found which enabled a switching from one mode to another with a slight rotational twist of a blade's holding tool within a user's hand.

Today's work environment of home based vinyl shops endanger small children and their visitors by exposing them to these dangerous cutting blades and picking styluses. The workplace location has rapidly changed from commercial storefronts to home based operations, and yet the working tools for this industry have not yet changed to meet more stringent and needed safety requirements.

Some tool holders do have various shaped cutting blades or picks which are compactly retained within their body; yet require unscrewing the tool holder itself, then unscrewing whichever tool is in use, and then screwing in a wanted tool cutting blade, or picker, or blunt end stylus. Many variations of tool blades and holders and clever ways of storing the tools within their holders soon lose their appeal when in an actual fast pace work situation. In the particular job of weeding vinyl material, and especially in today's new home work environment, speed and safety are crucial. Today's fast pace workplace requires much more speed and safety as a user switches from cutting blades to hold-down styluses to picks; and certainly much more speed and safety than what was previously provided by any prior art.

SUMMARY

A triple function slitting, picking, and holding safety blade for use in the graphic arts trade, for slitting through, picking up, and holding down of areas of computer cut vinyl adhesive material. A slight rotation of a user's blade holding tool changes a blade's function from slitting to picking to hold-down modes with increased user safety from its restricted blade penetration and fewer carpal tunnel stress motions.

OBJECTS AND ADVANTAGES

This invention of a slit, pick and hold safety blade may be newly formed from hardened metal, or newly formed prior to its hardening, or from a previously made metal blade, or a mold injected polymer plastic.

Accordingly, besides any objects and advantages previously described, more objects and advantages of this present invention are;

(a) to provide a cutting blade end area wherein a multiple choice of functions are accessible as a user slightly rotates a blade's tool holder;

(b) to provide choices of cutting and slitting, or hooking and picking, or a holding of a planar vinyl adhesive material to, or from its carrier sheet;

without causing damage to vinyl material via the hook's bluntly shaped safety bend.

(c) and to provide a safer cutting blade wherein a blade's depth of penetration is restricted by a curved and or angularly curved bend of its picking hook;

(d) to provide a blade end area which can be utilized by and merged with a manufacturers' choice of blade shank end shape and tool holder retaining designs;

(e) to provide a multi use blade wherein instant recognition of its orientation is seen by the angled direction of the blade's pointed picking hook.

(f) to provide a barb-less hook for easy removal of unwanted vinyl material;

(g) to provide a blade wherein a one directional pulling motion achieves either function of cutting or picking up of material with less stress upon a carpal tunnel sensitive and overly used hand;

(h) to provide a multi purpose blade for faster work production by eliminating a need for finding, picking up, and orienting a next tool for cutting and or picking and or holding actions;

(i) to provide a cutting pick safety blade for holding down wanted material without damaging the material via the hook's bluntly shaped safety bend.

BRIEF DESCRIPTION OF THE DRAWINGS

Drawings 1 Through 10

In the drawings, dotted lines represent a portion of a blade shank of any shape 20.

BRIEF DESCRIPTION OF THE DRAWINGS

Reference Numerals in Drawings

20—a blade's shank portion

30—a blade's main body portion

40—blade end area's elongate cutting edge

50—blade end area's non-cutting flat edge

60—a blade end's apex point; and also described as a first, or original cutting edge tip

70—a notch created cutting edge, and also described as a second cutting point

80—notched area

90—a bent portion

99—planar surface of material to be cut or slit

DETAILED DESCRIPTION OF THE DRAWINGS

Figure 1:
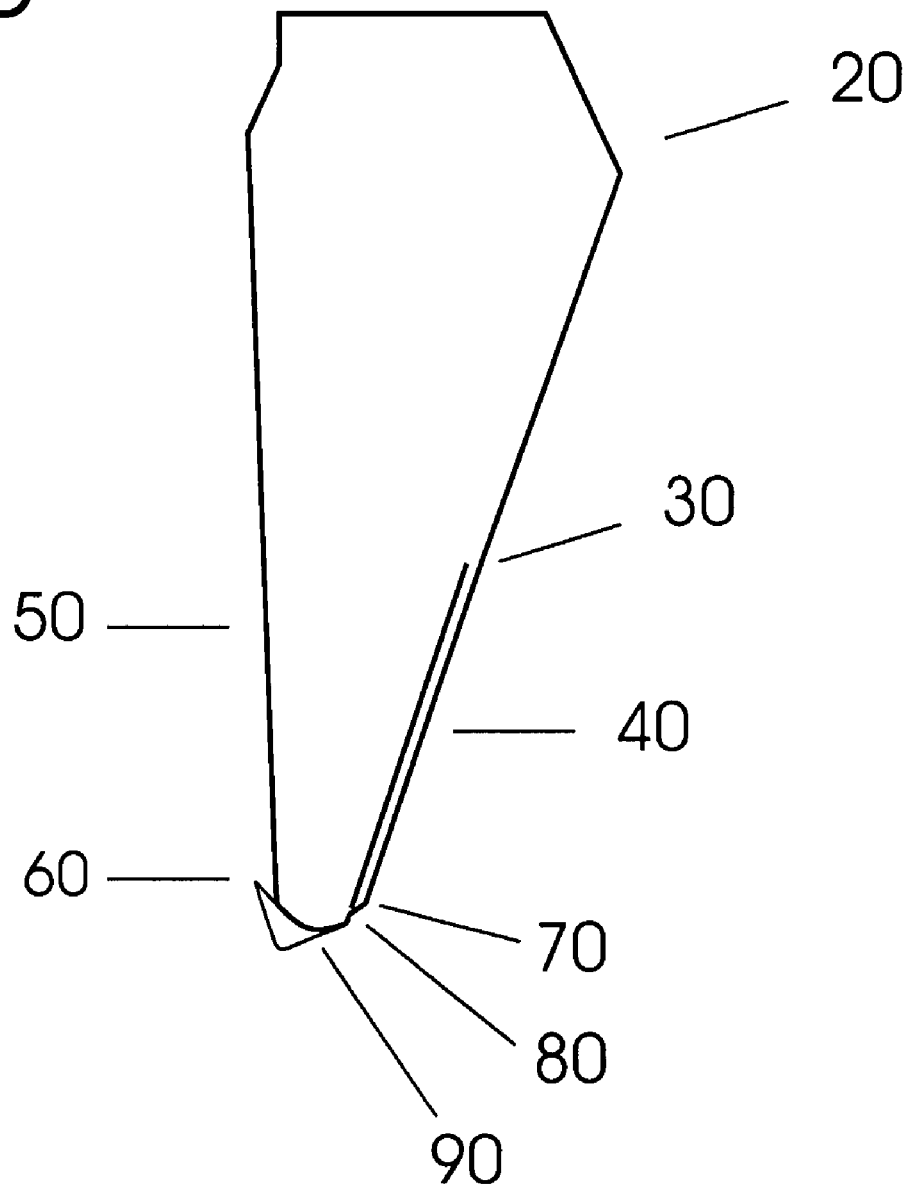
FIG. 1 is a side view of a preferred embodiment showing a notch within a blade's cutting edge, and a blade's end area which is curvedly and angularly bent to form a pointed hook shape.

FIG. 1—Preferred Embodiment

A preferred embodiment as in FIG. 1 comprises;

a planar and elongate triangular shape cutting blade with a least one cutting edge surface 40, and a blade end's apex point 60 and is also described as a first, or original cutting edge point 60. A notch 80 within the cutting edge surface 40 is located approximately ¼ to ½ inch inwardly from the cutting edge point 60. The notch 80 forms a new cutting edge 70 which is also described as a second cutting edge point 70. A bend 90 is located between the second cutting edge point 70 and the first cutting edge point 60 which directs the first cutting edge point 60 to point directionally away from the notch 80, and directionally toward the blade's non-cutting edge 50. A main body portion 30 is located further inward, and being near the blade's shank portion 20, which is not shown or described in detail within FIG. 1.

DETAILED DESCRIPTION OF THE DRAWINGS

Operation

A cutting pick safety blade may be newly formed from hardened metal, or newly formed prior to its hardening, or from a previously made blade, or polymer plastic.

The following description refers to forming a cutting pick safety blade from a previously made blade. The blade is preferably a thin and planar steel blade with a generally triangular shape, wherein it's blade shank of any shape 20 would be interchangeable with a chosen blade holder tool. Many tool holders are generally pencil like in shape and size.

Figure 2:
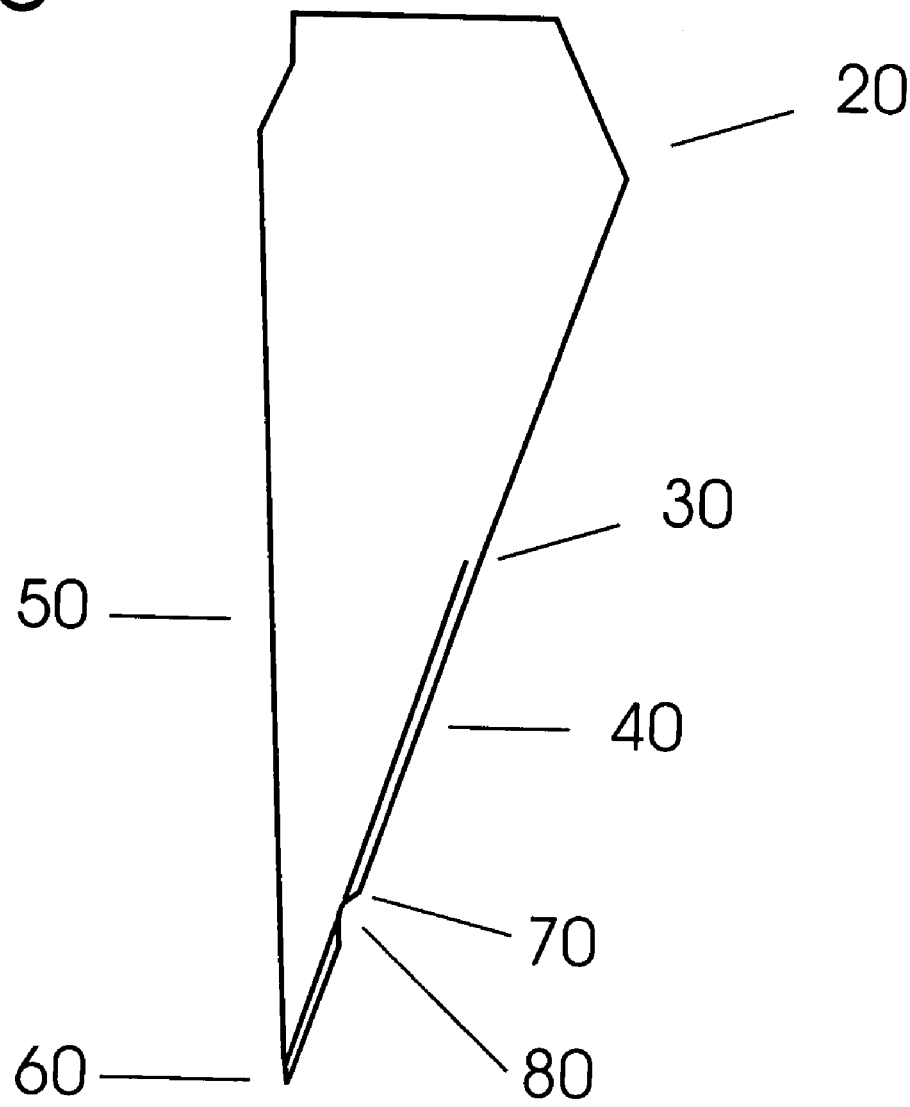
FIG. 2 is a side view of a preferred embodiment showing said notch, and prior to a forming of the hook shape.

A manufacturing user may punch, file or grind a notch 80, FIG. 2, near a blade end's cutting edge tip 60. Any sharpening or honing of the notch's 80 inwardly adjacent cutting edge 70 may depend on which previous method is used to create a notch 80, and depending on a user's preference in its degree of sharpness. The new, or second cutting edge 70 within the preferred embodiment of FIG. 1, is purposed to cut or slit a planar and thin layer of vinyl material 99, FIG. 6.

The notch 80 is located approximately from 3/16 inch in and up to ½ inch in from the blade's 30 original cutting edge tip 60, and within the blade end area's elongate cutting edge surface 40. An exact locational distance finally depends on an original size and length of the previously made blade.

Figure 6:
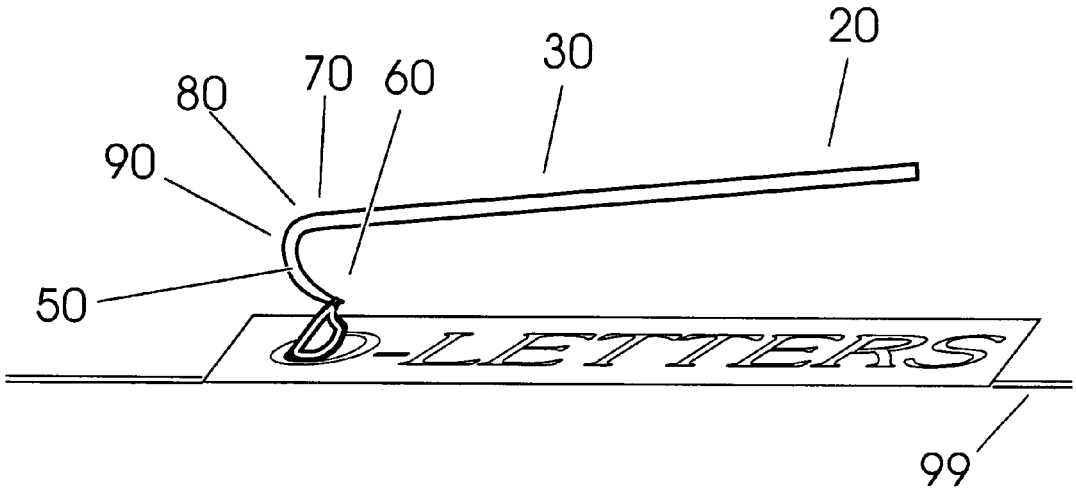
FIG. 6 is a side view of a blade as in FIG. 5, but after a blade and its holder are slightly rotated to a hook function position, and with the hook shown as it has pierced and is picking up unwanted vinyl material, and with a holder not shown.

The second cutting edge 70 is exposed to cut or slit a planar and thin layer of vinyl material 99, FIG. 6 surface after a bending of an area between the notch 80 and the original cutting edge tip 60. The bend's curvature begins within the notch, and ends near to and before reaching the original cutting edge tip 60. Shown in FIG. 2, is the inaccessibility of the new cutting edge tip's 70 clearance to abut and cut or slit a planar material's surface before the bend is formed.

The bending results in a rounded, bent hook shape 90. A tapered end of the triangular shape blade end area now curvedly rolls back and away from the second cutting edge 70 to provide sufficient clearance to abut and slit a material's planar surface 99. The round bend of the hook shape 90 is bent dimensionally and accordingly to a manufacturing user's preference for accessibility to a material's surface for both cutting and picking functions. The bend is quite functional, yet may limit a user in an angle in which a tool held blade is retained within their hand. The tool blade holder may be more closely parallel with a material's planar surface than desired with some users. A user's index finger would normally be parallel with the holder's elongate direction, and approximately located vertically above and near the held blade. Some users prefer this position of holding the tool held blade, while others prefer a more relaxed position, such as a hand held pen or pencil position when writing.

To achieve this more tolerant angle of a hand held blade holding tool, a manufacturing user may angle the bend of the hook shape 90 slightly towards a a blade end area's non-cutting flat edge 50. The angled bend now further exposes a new cutting edge 70 to permit a greater degree of angle in which the blade's tool holder is held. Note this difference in FIGS. 7 and 8.

The original cutting edge tip 60 is now a picking point of the rounded bend hook shape 90, and wherein the angle of the bend now further exposes the original cutting edge tip 60 further beyond the non-cutting edge 50, for easier accessibility to the material's surface 99 to be picked away. Note tip 60 in FIG. 1.

Figure 10:
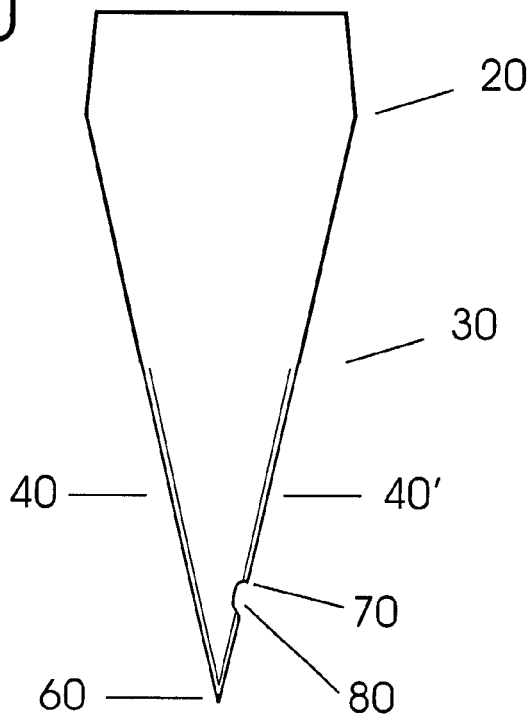
FIG. 10 is a side view showing an alternative embodiment with double edge cutting blade surfaces with a notch in place, and prior to a hook forming angled bend.

A manufacturing user may tweak any degrees of the bends, angles, or location of the notch to target a chosen market of users, and also accordingly to a size of blade chosen to accommodate their chosen blade tool holder, and or accordingly when a double edge cutting blade is chosen as an alternative embodiment FIG. 10.

Previous descriptions in the making of a slit, pick, and hold triple function graphic arts safety blade describe how to easily make the safety blade from a previously made blade, and are not intended to restrict the invention to any particular manufacturing process or material, or single or double edge cutting blade.

In using a slit pick and hold triple function graphic arts safety blade, a user or manufacturer may identify one or more planar sides with an added coloring for instant recognition of a blade's orientation or function.

Once oriented, a tool held safety blade is pulled by a user's hand for cutting around an area of vinyl material 99 to be weeded from it's carrier sheet. When cutting, the original cutting edge tip 60 of the hook 90 is positioned laterally to one side of the blade's end area, and with the point 60 angled slightly and approximately vertically upwards and away from the vinyl lettering material 99, FIG. 5. When cutting is completed, the hand held blade holding tool is slightly rotated within a user's fingers until the hook is in position to pierce the vinyl material 99, FIG. 6. As a user pulls the hook, it piercingly pricks and picks up the unwanted areas of vinyl material 99.

The pulling action of piercing and picking out any unwanted areas greatly reduces the amount of different muscles of a user's hand required to achieve a simple picking away of one small dot of thousands within the material 99. A user normally would grip any other awl-like tool tighter as they pierce and lift vertically upwards and in a direction away from their body. The directional movements are opposite from a cutting and or pulling motion. The hook of the safety blade permits a pulling motion for both picking and cutting functions.

The directional movements described in the picking action may not impact a user who hasn't experienced any type of repeated movements over and over on a daily basis within their workplace.

Yet, any user who has ever experienced carpal tunnel from a same and repeated motion thousands of times in a day, will recognize the importance of a pulling action versus the opposite motions now used, and wherein the motions are used only because of the few tools available within the marketplace to do the job. When picking any excess material, a user's other hand will easily remove any hooked material, as the hook has no extra barb projections within its hooked shape. A user may also prick and pick numerous and multiple unwanted pieces of material before removing from the hook. A user may then rotate their blade retaining tool holder for fast orientation of the second cutting edge without any need for stopping to reach for, and then reorienting another and separate cutting tool. When weeding vinyl material, at least one hand of a user is usually holding the material down and against their worktable while another hand is pulling material away from its carrier. Small and wanted areas within a line of lettering invariably pull away from their carrier sheet accidentally. A user normally reaches for a pair of tweezers, or a sharp pointed blade, or a blunt end stylus to hold down these extremely small lettering parts. Many accidental piercings of wanted areas of lettering occur with each attempt in holding these areas in place. The round ended portion of the hook shape 90, FIG. 9 will function to hold these areas without piercing the material 99, and with nominal rotation required for orientation of the tool held cutting pick safety blade. With the safety blade retaining tool in hand, a user may cut, or pick up unwanted areas, or hold down any wanted areas of vinyl material 99, and all without laying any tool down to search for another.

Today's sign market of home based vinyl shops expose children and visitors to its related weeding tools. A user will find a cutting pick safety blade much safer than any of the standard and exposed cutting blades or picking awls or long sharp picking tweezers that are now used in the industry. Any accidental piercing of a user's body is restricted by the rounded end of the hook, and if a piercing does occur, it is normally limited in depth by a hook's small size or round bend.

A user now has access to greater speed in their work, increased safety within their workplace, and more preventive safety against carpal tunnel hand disorders.

In addition, a manufacturer may easily incorporate and merge this blade end area 30 into most any of their previously chosen blade shank designs or shapes 20.

DETAILED DESCRIPTION OF THE DRAWINGS

FIGS. 2 thru 9

FIG. 2 shows a side view of a blade end area 30 after a notch 80 is placed within the blade end area's elongate cutting edge 40, and prior to a forming of a rounded safety bend of a hook shape. Note how a second, or new cutting edge tip 70 is now exposed, yet mostly inaccessible to cut or slit a planar material's surface, before any picking hook has been bendingly formed.

Figure 3:
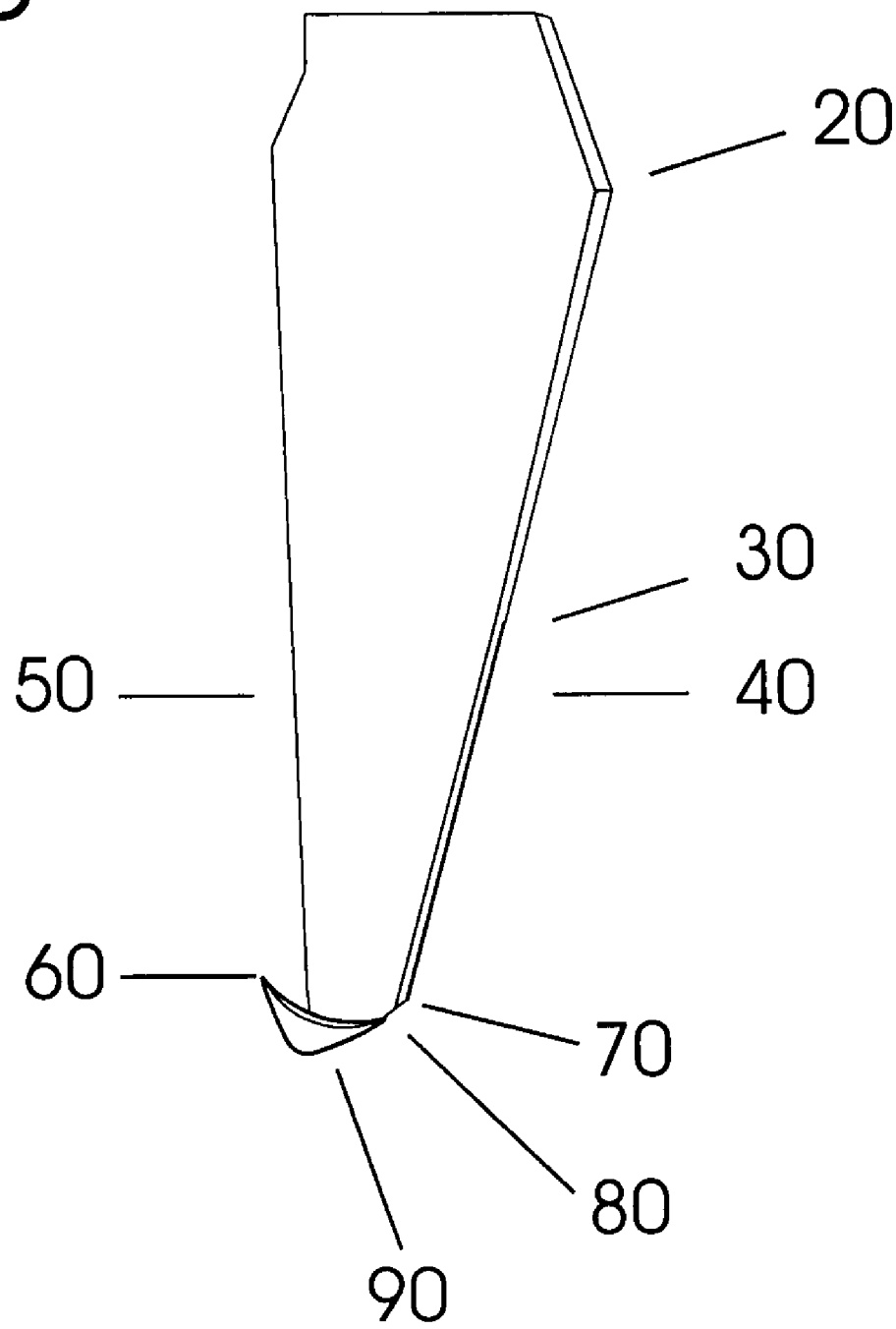
FIG. 3 is a side and slightly rotated view of FIG. 1's preferred embodiment, and where a cutting edge is slightly rotated toward a person viewing the drawing.

FIG. 3 is a side view of a preferred embodiment as in figure one, and with a slight rotation of said elongate cutting edge 40, and in a direction towards a viewer. Any thickness of a shown blade is approximated. Note an angle of an original cutting edge tip 60, and where it directionally points toward a non-cutting flat edge 50. The angle provides easier access for a blade's tool held hook picking position, and additional clearance for the second cutting edge 70 to slit a planar surface.

Figure 4:
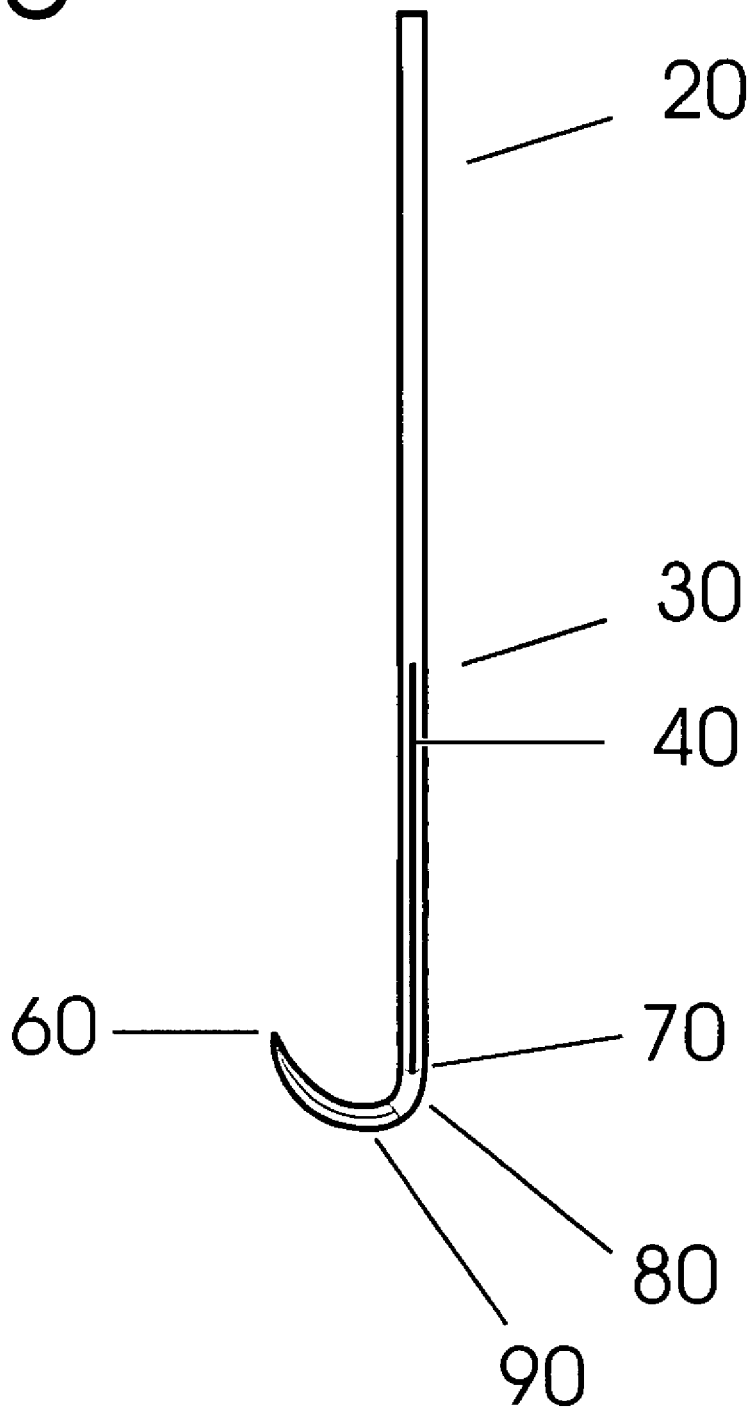
FIG. 4 is a side and 90 degree rotated view of FIG. 1's preferred embodiment, and where the edge is rotated completely toward a person viewing the drawing.

FIG. 4 is a side view of figure three, and shows the blade end area's elongate cutting edge 40. Again, a thickness of the blade is approximated. An angle shown of a rounded safety bend of the hook shape 90 is fairly accurate and may be slightly adjusted by a manufacturer or user to tweak to one's preference for its pickability. Note the notch 80 and the second cutting edge 70 within the elongate cutting edge 40. Note how the notch and the bend cooperate to allow further clearance for the second cutting edge 70 to abut and cut or slit a planar material's surface.

Figure 5:
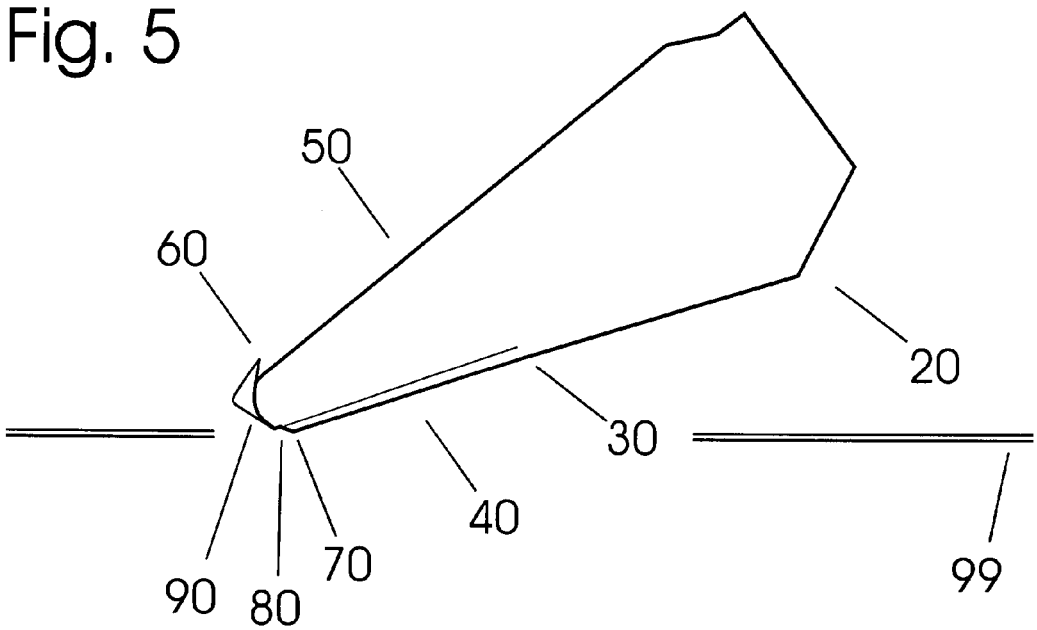
FIG. 5 is a side view of the preferred embodiment, and with its blade cutting edge in position for material cutting.

FIG. 5 is a side view wherein a blade is oriented with its elongate cutting edge 40 positioned to cut or slit an area of vinyl material 99. Note how its hook shape and original cutting edge tip 60 are angled vertically upwards and away from the material 99. The angled bend allows further clearance for the second cutting edge 70 to abut a material's 99 surface for cutting and slitting. The angled bend also allows further clearance for the original cutting edge tip 60 to extend beyond the blade end area's non-cutting flat edge 50 for a more tolerant degree of angle of a user's hand held blade holding tool. Note that the hook's picking point 60 is available for it's picking action with only an approximate few degrees or so rotational twist of a blade holding tool within a user's hand. A blade holding tool is not shown. A user can cut, pick and hold down material with only a few rotational and or pulling and or holding actions of a blade's tool holder being required.

FIG. 6 shows nearly a same position of a blade as in FIG. 5, but after the blade has been rotated for a hook positioned function. The blade's flat and non-cutting edge 50 is facing the drawing's viewer. Also shown is an interior and unwanted part of an alphabetical letter O, and after it has been pierced, pricked, or hooked, and as it is being lifted away from a vinyl material's 99 surface. Cutting motions are normally made in areas surrounding shown letters in order to weed out a background of the computer cut vinyl adhesive material 99.

Figure 7:
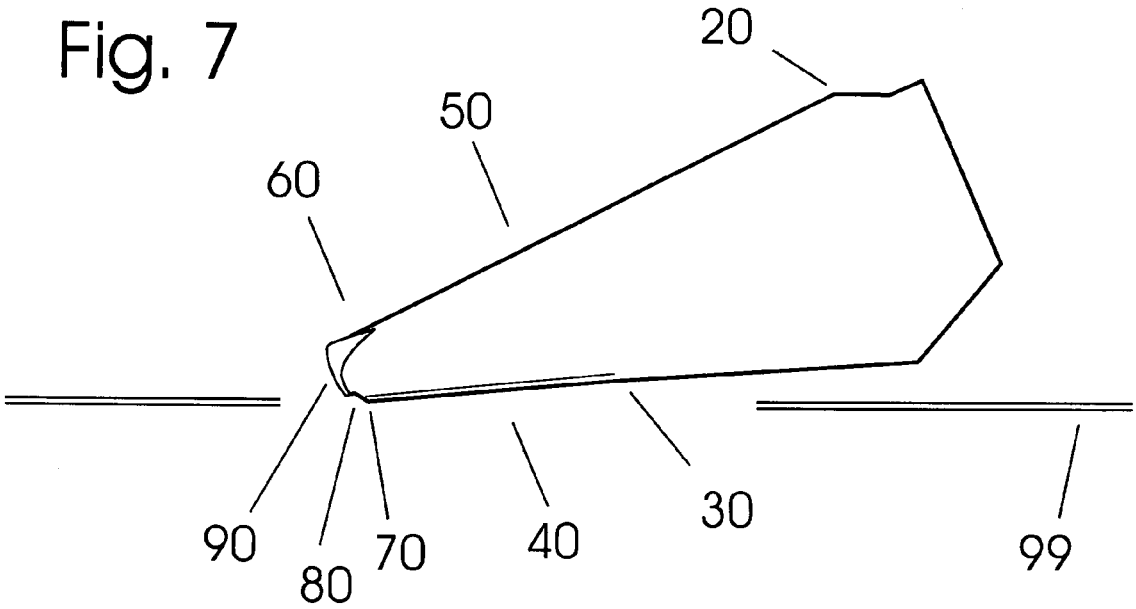
FIG. 7 is a side view as in FIG. 5, but with a curved hook shape shown without the previous angled bend, and where its cutting edge tip is still accessible to a material's surface for cutting, but with less tolerance in its tool held angled position.

FIG. 7 is a side view as in FIG. 5, but with a curved hook shape shown without the previous angled bend, and where its cutting edge tip is still accessible to a material's surface for cutting, but with less tolerance in its tool held angled position.

Figure 8:
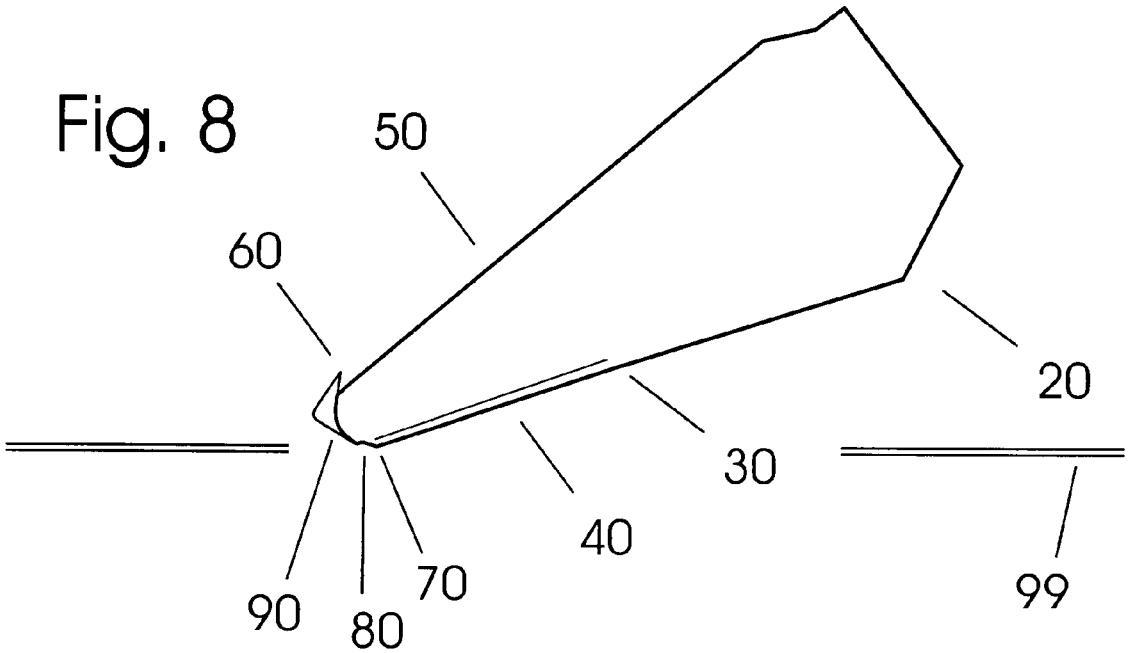
FIG. 8 is a side view as in FIG. 5, showing a curved and angled bend, and with a more tolerant tool holding position than FIG. 7, and which is due to the angle.

FIG. 8 is a side view as in FIG. 5, showing a curved and angled bend, wherein is a more tolerant tool holding position than FIG. 7, and which is due to the angle. Note differences in degree of angles between FIG. 7 and FIG. 8. FIG. 7 lacks an angle in its bend, yet functions fine. FIG. 8 is a preferred embodiment, as it allows a user more choice in an angle or position in which a tool held blade is used.

Figure 9:
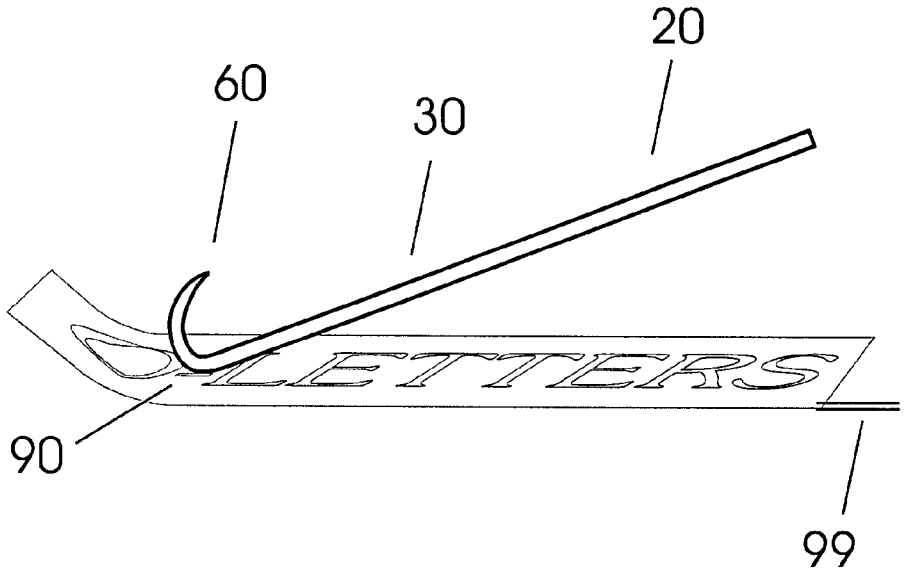
FIG. 9 is a side view showing the hook's blunt, rounded, and angled bend holding down wanted material as a user is pulling up unwanted vinyl background, and with the user and blade holding tool not shown.

FIG. 9 is a side view showing a hook's blunt, rounded, and angled bend; as if a user were weeding out unwanted background material.

DETAILED DESCRIPTION OF THE DRAWINGS

Continued—Alternative Embodiment—FIG. 10

Shown in FIG. 10 is an alternative embodiment of a double edged 40, 40' triangular shaped blade end area 30, and as when a manufacturer chooses a double edged cutting surface blade as their preference. Shown also is a notch placed within one of the cutting edges, and prior to any forming of a hook forming angled bend. In using a double edged triangular shape blade, the first cutting edge point may make any pricking or piercing of a substrate a little easier by providing a sharper double edged hooked point, and without hindering other functions.

CONCLUSION, RAMIFICATIONS, AND SCOPE

Accordingly, the reader will see that the scope of this new cutting, picking, and holding blade goes beyond it's many advantages over many previous blades.

Faster production is achieved through this blade's versatility and with increased and preventive safety features in its use.

Although previous descriptions contain many specificities, these should not be construed as limiting the scope of the invention but as merely providing illustrations of the presently preferred embodiment of this invention.

The invention claimed is:

1. A generally elongate triangular shape cutting blade comprising:

a pointed apex;

a notch formed within an elongate cutting edge of said blade;

a sharp cutting edge point formed by said notch;

wherein said pointed apex is located at a tip end of said blade;

wherein said notch is located near said pointed apex;

wherein said notch exposes said sharp cutting edge point;

wherein an area between said pointed apex and said sharp cutting edge point comprises a curved or angled bend;

wherein said bend further exposes said sharp cutting edge point with sufficient clearance to cut or slit a planar material's surface;

wherein a pointed picking hook comprises said pointed apex and a portion of said bend; and wherein an exterior portion of said bend forms a blunt surface.

* * * * *